US010337458B2

(12) United States Patent
Raffenberg et al.

(10) Patent No.: US 10,337,458 B2
(45) Date of Patent: Jul. 2, 2019

(54) CARBURETOR AND METHOD FOR OPERATING AN INTERNAL COMBUSTION ENGINE HAVING SAID CARBURETOR

(71) Applicant: Andreas Stihl AG & Co. KG, Waiblingen (DE)

(72) Inventors: Michael Raffenberg, Fellbach (DE); Antonio Fattorusso, Kernen im Remstal (DE); Isgard Sabelberg, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 15/017,489

(22) Filed: Feb. 5, 2016

(65) Prior Publication Data

US 2016/0230704 A1 Aug. 11, 2016

(30) Foreign Application Priority Data

Feb. 5, 2015 (DE) ..... 10 2015 001 452

(51) Int. Cl.
*F02M 9/08* (2006.01)
*F02B 25/14* (2006.01)
(Continued)

(52) U.S. Cl.
CPC ..... *F02M 9/08* (2013.01); *F02B 25/14* (2013.01); *F02B 25/20* (2013.01); *F02D 9/16* (2013.01);
(Continued)

(58) Field of Classification Search
CPC ..... F02M 9/08; F02M 1/043; F02M 1/10; F02M 9/085; F02M 17/38; F02M 9/125;
(Continued)

(56) References Cited

U.S. PATENT DOCUMENTS 1,737,496 A * 11/1929 Feroldi ..... F02M 1/04 261/41.5
2,578,857 A * 12/1951 Sumpter ..... F02M 9/085 261/41.3
(Continued)

FOREIGN PATENT DOCUMENTS

CN 1793635 A 6/2006
DE 32 47 603 A1 7/1983
(Continued)

*Primary Examiner* — David E Hamaoui
(74) *Attorney, Agent, or Firm* — Walter Ottesen, P.A.

(57) ABSTRACT

A carburetor has a housing wherein a control drum is rotatably mounted. A section of an intake channel is formed in the carburetor. A subsection of this section is formed in the control drum. The control drum controls the free flow cross section of the intake channel. A fuel opening is connected to a fuel chamber via an unbranched fuel channel which opens into the subsection of the intake channel. A simple configuration of the carburetor is achieved by the carburetor including an electrically actuated valve which controls the flow of fuel through the fuel channel. For a method for operating an internal combustion engine with a carburetor, a temperature (T) is determined before or during the starting of the engine and that the flow of fuel through the fuel channel during the starting of the engine is controlled in dependence upon the temperature (T).

5 Claims, 3 Drawing Sheets

(51) Int. Cl.

| | |
|---|---|
| ***F02M 1/10*** | (2006.01) |
| ***F02M 9/12*** | (2006.01) |
| ***F02M 17/02*** | (2006.01) |
| ***F02M 17/38*** | (2006.01) |
| ***F02D 9/16*** | (2006.01) |
| ***F02B 25/20*** | (2006.01) |
| ***F02M 1/04*** | (2006.01) |
| *F02M 7/28* | (2006.01) |
| *F02M 19/06* | (2006.01) |
| *F02D 41/06* | (2006.01) |
| *F02D 41/08* | (2006.01) |

(52) U.S. Cl.
CPC ..... *F02M 1/043* (2013.01); *F02M 1/10* (2013.01); *F02M 9/085* (2013.01); *F02M 9/125* (2013.01); *F02M 17/02* (2013.01); *F02M 17/38* (2013.01); *F02D 41/064* (2013.01); *F02D 41/08* (2013.01); *F02M 7/28* (2013.01); *F02M 19/06* (2013.01)

(58) Field of Classification Search
CPC ..... F02M 17/02; F02M 19/06; F02M 7/28; F02B 25/20; F02B 25/14; F02D 9/16; F02D 41/064; F02D 41/08
See application file for complete search history.

(56) References Cited

U.S. PATENT DOCUMENTS

| | | | | |
|---|---|---|---|---|
| 2,926,007 | A * | 2/1960 | Pettit | F02B 75/34 261/44.8 |
| 3,903,925 | A * | 9/1975 | Perry | F02B 9/06 137/625.3 |
| 4,271,096 | A * | 6/1981 | Kobayashi | F02M 9/08 261/44.8 |
| 4,335,062 | A * | 6/1982 | Kobayashi | F02M 9/085 261/44.8 |
| 5,611,312 | A * | 3/1997 | Swanson | F02M 1/02 123/179.18 |
| 5,942,160 | A * | 8/1999 | Araki | F02M 1/16 261/44.8 |
| 6,394,424 | B2 * | 5/2002 | Pattullo | F02M 17/04 261/35 |
| 6,585,235 | B2 * | 7/2003 | Pattullo | F02M 9/08 261/44.8 |
| 7,261,281 | B2 | 8/2007 | Raffenberg | |
| 7,509,941 | B2 * | 3/2009 | Ottosson | F02M 7/16 123/406.45 |
| 7,722,015 | B2 * | 5/2010 | Koizumi | F02M 17/04 123/73 PP |
| 8,166,931 | B2 * | 5/2012 | Zwimpfer | F02D 9/16 123/73 AA |
| 8,261,775 | B2 * | 9/2012 | Aihara | F02M 9/12 137/595 |
| 8,616,179 | B2 * | 12/2013 | Quantz | F02D 9/16 123/190.12 |
| 9,512,806 | B2 * | 12/2016 | Osburg | F02M 1/02 |
| 2014/0216402 | A1 * | 8/2014 | Oppenlander | F02M 3/10 123/437 |
| 2014/0352660 | A1 | 12/2014 | Kurzenberger et al. | |
| 2014/0360467 | A1 * | 12/2014 | Osburg | F02M 9/06 123/403 |

FOREIGN PATENT DOCUMENTS

| | | | |
|---|---|---|---|
| FR | 599 841 | A | 1/1926 |
| FR | 1 366 889 | A | 7/1964 |
| JP | 9-151801 | A | 6/1997 |
| WO | 2007/077971 | A1 | 7/2007 |

* cited by examiner

CARBURETOR AND METHOD FOR OPERATING AN INTERNAL COMBUSTION ENGINE HAVING SAID CARBURETOR

CROSS REFERENCE TO RELATED APPLICATION

This application claims priority of German patent application no. 10 2015 001 452.8, filed Feb. 5, 2015, the entire content of which is incorporated herein by reference.

FIELD OF THE INVENTION

The invention relates to a carburetor, wherein the carburetor has a housing, wherein a section of an intake channel is formed in the carburetor, wherein a control drum, in which a subsection of the intake channel is formed, is mounted rotatably in the housing, wherein the control drum controls the free flow cross section of the intake channel, wherein the carburetor has a fuel chamber, wherein a fuel opening, which is connected to the fuel chamber via an unbranched fuel channel, opens into the subsection of the intake channel, and to a method for operating an internal combustion engine with a carburetor.

BACKGROUND OF THE INVENTION

DE 32 47 603 A1 discloses a carburetor which has a rotatable control drum. The quantity of fuel supplied is controlled via a needle which projects into a fuel opening. In order to adapt the quantity of fuel supplied during idle, an opening is provided in a wall of the control drum, the opening being configured in such a manner that a larger air opening arises on the upstream side of the control drum than on the downstream side.

During the starting, an increased quantity of fuel has to be supplied via the carburetor. For this purpose, it is known to raise the control drum via an actuating mechanism in such a manner that the free cross section of the fuel opening is increased, and at the same time to rotate the control drum in order to increase the opening cross section of the intake channel.

It is also known from WO 2007/077971 A1 to provide, for the starting operation, an additional fuel path which is controlled by an electromagnetic valve. The free cross section of the main fuel opening is controlled by a needle.

SUMMARY OF THE INVENTION

It is an object of the invention to provide a carburetor which has a simple configuration. It is a further object of the invention to provide a method for operating an internal combustion engine with the carburetor.

This object is achieved with regard to the carburetor by a carburetor which includes an electrically actuated valve which controls the flow of fuel through the fuel channel. With regard to the method, the object is achieved by a method for operating an internal combustion engine with a carburetor, wherein a temperature is determined before or during the starting of the internal combustion engine, and wherein the flow of fuel through the fuel channel during the starting of the internal combustion engine is controlled in dependence upon the temperature.

The carburetor includes an electrically actuated valve which controls the flow of fuel through the fuel channel. Owing to the fact that the fuel channel is unbranched, the valve controls the entire quantity of fuel supplied to the intake channel. As a result, during the starting, an increased quantity of fuel can be supplied via the valve without a further additional fuel path being necessary. Owing to the fact that the increased quantity of fuel during the starting is metered by the valve, a manual adjustment of a choke position is not necessary. As a result, a corresponding actuating mechanism can be omitted.

It has been demonstrated that, for a sufficient supply of fuel during the starting of an internal combustion engine at low temperatures, a very large quantity of fuel should be supplied. Since the entire quantity of fuel supplied to the intake channel is controlled via the valve, the valve therefore has to have a comparatively large maximum volume flow rate. By contrast, the quantity of fuel to be supplied during operationally hot idle is very small. At the same time, the negative pressure at the fuel opening is comparatively large. In the case of valves with a high maximum volume flow rate, the quantity of fuel to be supplied during idle may be so small that the provided opening times of the valve lie within the order of magnitude of the switching accuracy of the valve. As a result, a reliable supply of a small quantity of fuel during idle is not readily possible. In order nevertheless to permit the use of a simply configured electromagnetic valve, it is provided that the subsection of the intake channel, which subsection is formed in the control drum, is connected in at least one rotational position of the control drum via an entry aperture to that section of the intake channel which is located upstream of the control drum and via an exit aperture to that section of the intake channel which is located downstream of the control drum, wherein, for at least one rotational position of the control drum, the flow cross section of the exit aperture is smaller than the flow cross section of the entry aperture. Owing to the fact that the flow cross section of the entry aperture is increased relative to the exit aperture, the negative pressure at the fuel opening is reduced for the rotational position of the control drum. Accordingly, by increasing the entry aperture of the control drum in relation to the exit aperture, the supplied quantity of fuel can be reduced with the flow cross section of the fuel opening remaining unchanged. This permits the use of a simply configured, electrically actuated valve in order to supply the entire quantity of fuel supplied to the intake channel both for starting at low temperatures and for operationally hot idle.

In particular in the case of a rotational position of the control drum that is assigned to the idle, the flow cross section of the exit aperture is smaller than the flow cross section of the entry aperture. In the at least one rotational position, the flow cross section of the exit aperture is advantageously at most 80% of the flow cross section of the entry aperture. The flow cross section of the exit aperture is advantageously at most 70%, in particular at most 60%, of the flow cross section of the entry aperture. A flow cross section of the exit aperture of approximately 50% of the flow cross section of the entry aperture has proven particularly advantageous.

Even at a low partial load, the quantity of fuel to be supplied to the intake channel is very small. For all of the rotational positions of the control drum, which correspond to an angle of rotation of the control drum from the idle position in the direction of the completely open position of 0° to 20°, in particular of 0° to 40°, the flow cross section of the exit aperture is advantageously smaller than the flow cross section of the entry aperture. In order to achieve a low flow resistance at full load, it is advantageously provided that the flow cross section of the exit aperture is the same size as the flow cross section of the entry aperture in the completely open position of the control drum. For all of the rotational positions of the control drum, which correspond to an angle of rotation of the control drum from the completely open position in the direction of the idle position of 0° to 5°, in particular of 0° to 10°, preferably of 0° to 20°, the flow cross section of the exit aperture is advantageously the same size as the flow cross section of the entry aperture. As a result, a high negative pressure can be achieved at the fuel opening in full load, and therefore the high quantity of fuel required for the full load operation can be delivered.

By adaptation of the flow cross sections of entry aperture and exit aperture, in particular for rotational positions of the control drum that correspond to the idle position and to the low partial load, an additional control of the flow cross section of the fuel opening is not necessary. The free flow cross section of the fuel opening is advantageously the same size for each position of the control drum. As a result, a needle for controlling the flow cross section of the fuel opening and also a mechanism which moves the control drum in the direction of the axis of rotation thereof depending on the rotational position thereof can likewise be omitted. The adjustment of the idle oiliness, which otherwise takes place by rotation of the needle mounted in the thread, can take place by means of the electrically actuated valve. The control drum is advantageously mounted in the housing in such a manner that, in the event of a rotational movement of the control drum, no lifting movement takes place in the direction of the axis of rotation of the control drum. This results in a significantly simplified configuration of the carburetor. Fewer individual parts are required for producing the carburetor. Since the quantity of fuel supplied takes place via the electrically actuated valve, the tolerances to be observed are comparatively large, thus resulting in simple production.

The fuel opening is in particular the single fuel opening opening into the intake channel in the carburetor. The fuel opening advantageously opens into the intake channel in the control drum. The valve is advantageously an electromagnetic valve. The valve is preferably a valve which is open in the currentless state.

For a method for operating an internal combustion engine with a carburetor, it is provided that a temperature is determined before or during the starting of the internal combustion engine and that the flow of fuel through the fuel channel during the starting of the internal combustion engine is controlled depending on the temperature. The temperature here is advantageously a temperature of the internal combustion engine or is correlated to the temperature of the internal combustion engine. The temperature is in particular a temperature of a crank case of the internal combustion engine or a temperature of a control device of the internal combustion engine. On the basis of the temperature, it can be determined whether cold starting conditions or hot starting conditions prevail, and a decision can be made as to whether the internal combustion engine should be started with a quantity of fuel for a cold start or with a quantity of fuel for a hot start. Since the quantity of fuel supplied is controlled depending on the temperature, a separate choke element which has to be actuated by the operator can be omitted. A simple configuration of the internal combustion engine results. The control drum is advantageously the single component controlling the flow cross section of the intake channel. This results in simple operation since the supply of a sufficient quantity of fuel during the starting is automatically undertaken by the internal combustion engine depending on the temperature. A starting position does not have to be engaged by the operator. The decision as to whether cold starting conditions or hot starting conditions prevail is also undertaken by a controlling means of the internal combustion engine itself and not by the operator. The internal combustion engine is advantageously started with an intake channel cross section which is assigned to idle. As a result, an adjustment of the control drum into a starting position with a changed, that is, increased or reduced, flow cross section of the intake channel can be omitted.

If the internal combustion engine is intended to be started even at very low temperatures, the valve must permit a comparatively large volume flow rate of the fuel. In order to avoid overly enriching the internal combustion engine during idle, and at the same time during idle and under cold starting conditions to permit the same free flow cross section of the fuel opening, it is advantageously provided that, during idle, fuel is not supplied into the intake channel in individual engine cycles. For example, during idle, it is possible for fuel not to be supplied into the intake channel during every second or every third engine cycle. The number of engine cycles in which fuel is supplied can be appropriately selected here. As a result, sufficiently long opening durations of the electrically actuated valve can be achieved in the engine cycles in which the valve opens. The internal combustion engine is advantageously a two-stroke engine, and the intake channel supplies the fuel into a crank case of the internal combustion engine. However, the internal combustion engine may also be a mixture-lubricated four-stroke engine in which the intake channel opens into the crank case. Mixing of mixture and combustion air takes place in the crank case, leading to a uniform supply of fuel, even if fuel is not supplied into the intake channel in individual engine cycles.

The supply of fuel into the intake channel only in individual engine cycles is advantageously provided for an internal combustion engine which may also be started below −5° C. In an advantageous manner, it is identified when the first combustion takes place, and, after a combustion has been identified, the quantity of fuel supplied to the internal combustion engine during starting is significantly reduced. As a result, overly enriching the internal combustion engine after the starting can be avoided in a simple manner.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
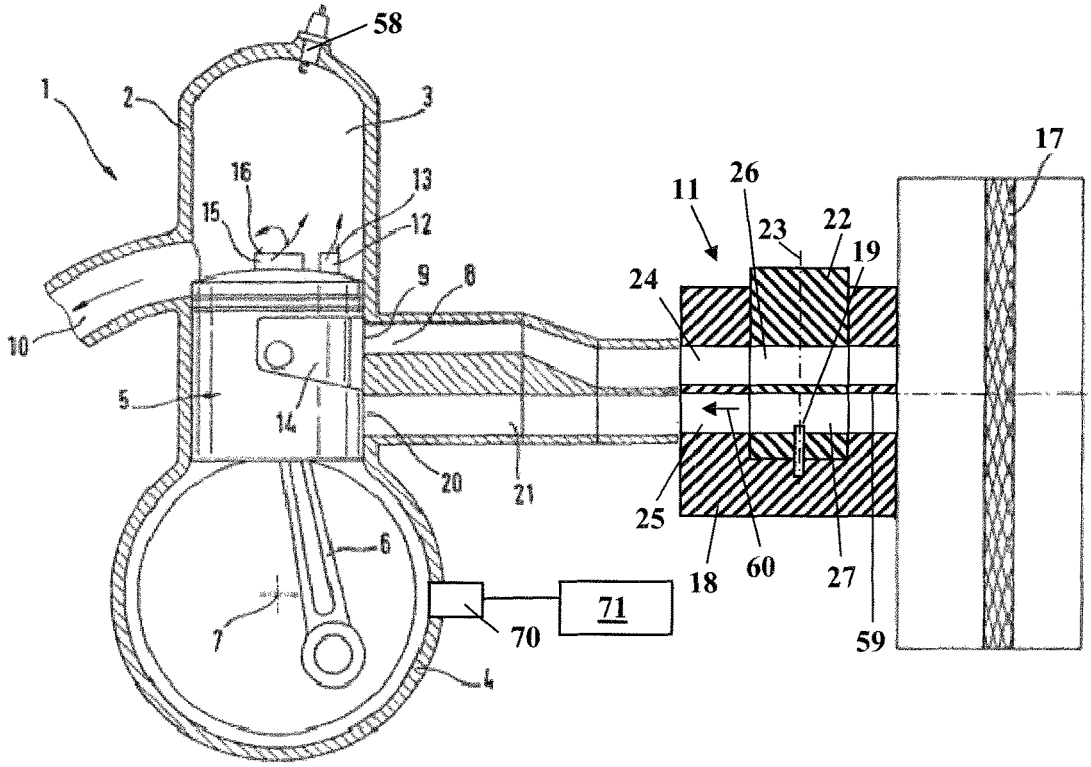
FIG. 1 shows a schematic sectional illustration through an internal combustion engine.

FIG. 1 shows a two-stroke engine 1 as an embodiment for an internal combustion engine. The two-stroke engine 1 is configured as a single-cylinder engine. Instead of the two-stroke engine 1, a mixture-lubricated four-stroke engine may also be provided. The two-stroke engine 1 operates with a scavenging gas shield. However, a two-stroke engine operating without a scavenging gas shield may also provided. The two-stroke engine 1 serves in particular for driving the tool of a handheld work apparatus, such as a motor-driven chainsaw, a brushcutter, a cutoff machine, a blower, a lawnmower or the like.

The two-stroke engine 1 has a cylinder 2 in which a combustion chamber 3 is formed. The combustion chamber 3 is delimited by a piston 5 mounted in a reciprocating manner in the cylinder 2. The piston 5 drives, via a connecting rod 6, a crankshaft 7 rotatably mounted in a crankcase 4. In the region of the bottom dead center (shown in FIG. 1) of the piston 5, the interior of the crankcase 4 is connected to the combustion chamber 3 via transfer channels 12 in the vicinity of the inlet and transfer channels 15 in the vicinity of the outlet. In the embodiment shown, two transfer channels 12 in the vicinity of the inlet and two transfer channels 15 in the vicinity of the outlet are in each case provided. The transfer channels are arranged symmetrically with respect to the section plane in FIG. 1. The inlet-near transfer channels 12 open with transfer windows 13 into the combustion chamber 3 and the outlet-near transfer channels 15 with transfer windows 16. An outlet 10 controlled by the piston 5 leads out of the combustion chamber 3.

The two-stroke engine 1 draws in combustion air via an air filter 17 and a carburetor 11. In the carburetor 11, fuel is supplied into an intake channel 21 which opens with an intake channel inlet 20 at the cylinder bore. The intake channel inlet 20 is also controlled by the piston 5. In addition, the two-stroke engine 1 has an air channel 8 which is likewise controlled by the carburetor 11 and which opens at the cylinder 2 via an air inlet 9. The air inlet 9 is also controlled by the piston 5. The piston 5 has a piston pocket 14 via which the air inlet 9 is connected to the transfer windows 13 and 16 of the transfer channels 12 and 15 in the region of the top dead center of the piston 5. A partition wall 59 separates the intake channel 21 from the air channel 8. The partition wall 59 extends at least in the carburetor 11 downstream of the fuel opening 19. In the embodiment shown, the partition wall 59 extends over the entire length of the carburetor 1 and downstream of the carburetor 11.

The carburetor 11 has a housing 18 in which a section 24 of the air channel 8 and a section 25 of the intake channel 21 are formed. A control drum 22 is mounted rotatably about an axis of rotation 23 in the housing 18 of the carburetor 11. The axis of rotation 23 extends transversely with respect to intake channel 21 and air channel 8 and extends through the two channels. A fuel opening 19, which opens into the intake channel 21 and supplies fuel to the intake channel 21, is formed on the control drum 22. The fuel is drawn up into the intake channel 21 because of the negative pressure prevailing in the intake channel 21. The combustion air and the fuel/air mixture flow in the carburetor 11 in a direction of flow 60 from the air filter 17 in the direction of the cylinder 2. A subsection 26 of the air channel 8 and a subsection 27 of the intake channel 21 are formed in the control drum 22. By rotating the control drum 22 about the axis of rotation 23, the free flow cross section of the section 24 of the air channel 8 and of the section 25 of the intake channel 21 is adjustable.

During operation, the piston 5 opens the intake channel inlet 20 during the upward stroke. Owing to the negative pressure in the crankcase 4, fuel is sucked up out of the fuel opening 19 in the carburetor 11 into the intake channel 21 and is drawn up as a fuel/air mixture together with the drawn-up combustion air into the crankcase 4. In the region of the top dead center of the piston 5, air which is low in fuel or is substantially free of fuel is drawn up via the piston pocket 14 from the air inlet 9 of the air channel 8 into the transfer channels 12 and 15 via the transfer windows 13 and 16. The drawing up of the air from the air channel 8 also takes place because of the negative pressure in the crankcase 4. During the downward stroke of the piston 5, the fuel/air mixture in the crankcase 4 is compressed. The downwardly moving piston 5 opens the transfer windows 13 and 16 before the bottom dead center is reached. Then, the air which is substantially free of fuel and is stored upstream in the transfer channels 12 and 15 first of all flows into the combustion chamber 3 and flushes out exhaust gases from the preceding engine cycle through the outlet 10. Fresh mixture subsequently flows into the combustion chamber 3 from the crankcase 4.

During the following upward stroke of the piston 5, the mixture is compressed in the combustion chamber 3 and is ignited in the region of the top dead center of the piston 5 by a spark plug 58 projecting into the combustion chamber 3. Owing to the combustion in the combustion chamber 3, the piston 5 is accelerated back in the direction of the crankcase 4. As soon as the piston 5 opens the outlet 10 during the downward stroke, the exhaust gases begin to flow out of the combustion chamber 3. The mixture drawn up during the preceding upward movement of the piston 5 is simultaneously compressed in the crankcase 4 and air from the air channel 8 is stored upstream in the transfer channels 12 and 15. The air stored upstream flows into the combustion chamber 3 as soon as the piston 5 has opened the transfer windows 13 and 16. The remaining exhaust gases are flushed out through the outlet 10 by the air, which is substantially free from fuel, flowing into the combustion chamber 3 via the transfer channels 12 and 15.

Figure 2:
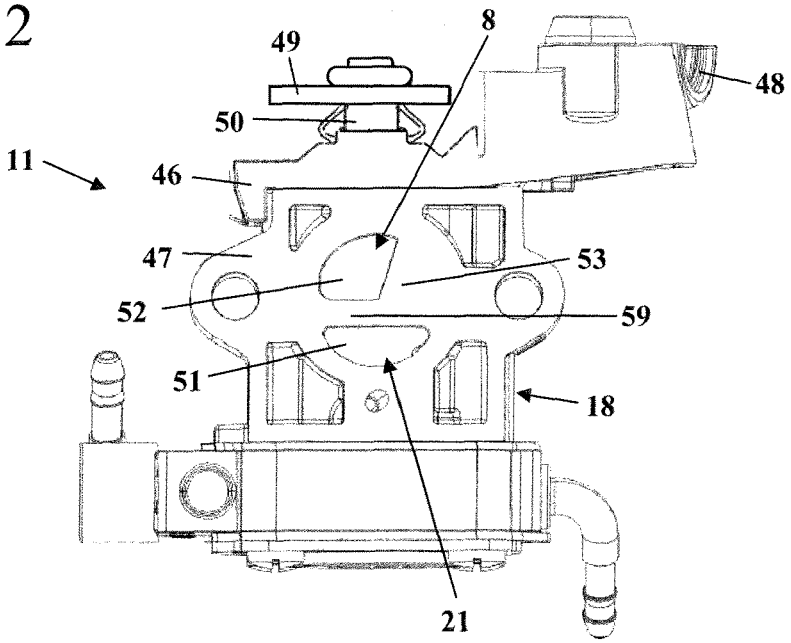
FIG. 2 shows a side view of the carburetor of the internal combustion engine from FIG. 1.

FIG. 2 shows the carburetor 11 in a side view. The housing 18 of the carburetor 11 includes a base body 47 to which a cover 46 is fastened. An entry aperture 51 for the intake channel 21 and an entry aperture 52 for the air channel 8 are formed on the basic body 47. As FIG. 2 shows, the entry apertures 51 and 52 are separated from each other by the partition wall 59. As FIG. 2. further shows, the partition wall 59 is not arranged centrally, but rather is offset toward the intake channel 21, thus producing a flow cross section of the intake channel that is smaller than the flow cross section of the air channel 8. As FIG. 2 shows, a wall section 53 which reduces the flow cross section of the entry aperture 52 is provided at the entry aperture 52 for the air channel 8. The wall section 53 is provided here in such a manner that the air channel 8 is closed in the idle position of the control drum 22. The control drum 22 is mounted in the cover 46 with a bearing shaft 50 which is shown in FIG. 2.

An actuating lever 49 is arranged on the bearing shaft 50 and a throttle cable (not shown) engages with this actuating lever. The throttle cable can be connected to a throttle lever of a work apparatus. The throttle cable is advantageously a Bowden cable. For the fixing of the sheath of the Bowden cable, a holder 48 is provided on the cover 46 of the carburetor 11. However, a different actuation of the bearing shaft 50 or of the control drum 22, for example via a linkage, may also be advantageous.

Figure 3:
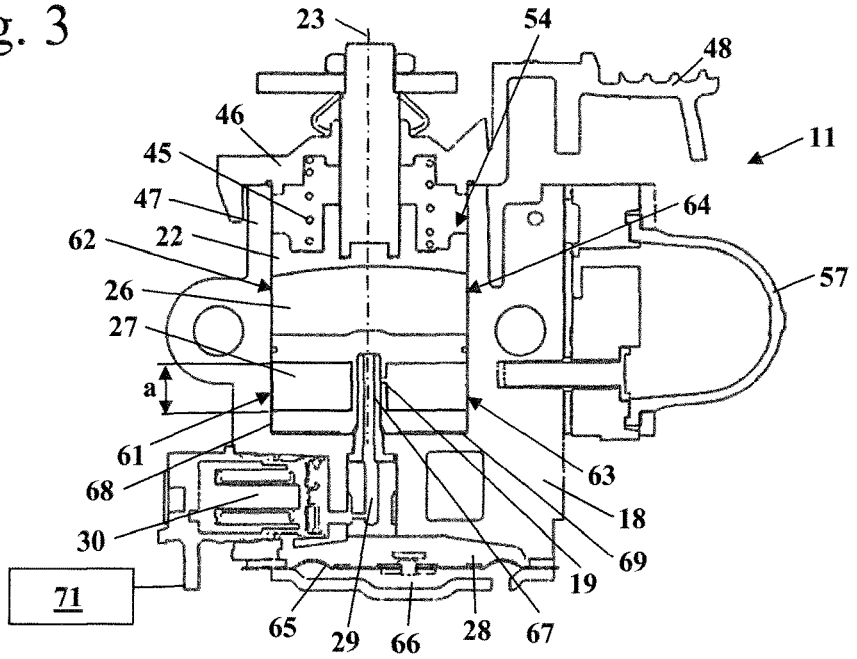
FIG. 3 is a schematic sectional illustration through the carburetor from FIG. 2 in the idle position.

FIG. 3 schematically shows the configuration of the carburetor 11. The control drum 22 is shown here in an idle position 54. In the idle position 54, the control drum 22 bears against a stop (not shown) which is advantageously adjustable in order to adjust the idle. In the schematic in FIG. 3, the direction of flow 60 (FIG. 1) is directed from behind the image plane forward, that is, out of the image plane. The idle position 54 is an end position of the control drum 22. A fuel chamber 28 is formed in the housing 18 of the carburetor 11. In the embodiment, the fuel chamber 28 is separated from a compensation chamber 66 via a membrane 65. The compensation chamber 66 is open toward the ambient, and therefore ambient pressure prevails in the compensation chamber 66. In order to supply fuel into the fuel chamber 28, a pump, for example, in particular a diaphragm pump driven by the fluctuating crankcase pressure, can be provided. In order to flood the fuel system after a relatively long shut down prior to the starting, a feed pump is provided in the embodiment, the pump bellows 57 of which is shown in FIG. 3. The fuel chamber 28 is connected to the fuel opening 19 via a fuel channel 29. In the embodiment, the fuel opening 19 is formed on a longitudinal side of a tube 67 which projects into the subsection 27 of the intake channel 21. However, a different configuration of the fuel opening 19, in particular on the end side of a tube 67, may be advantageous. The volume flow rate of the fuel through the fuel channel 29 is controlled by a valve 30 which is configured as an electromagnetic valve. The fuel channel 29 is formed unbranched. An unbranched fuel channel 29 here is a fuel channel in which the entire quantity of fuel flowing through the fuel channel 29 is controlled by the valve 30 and opens into the intake channel 21 via the fuel opening 19.

FIG. 3 also shows the configuration of the subsection 27 of the intake channel 21 in detail. The subsection 27 has an entry opening 61 which has a height (a), measured parallel to the axis of rotation 23, and an exit opening 63. The height of the subsection 27 at the exit opening 63 corresponds to the height (a) at the entry opening 61.

The subsection 26 of the air channel has an entry opening 62 and an exit opening 64. The entry opening 62 and the exit opening 64 are identical in size.

The control drum 22 is mounted in the housing 18 in such a manner that the control drum 22 does not execute any lifting movement during rotation about the axis of rotation 23 thereof. It can be provided that the control drum 22 is fixed for this purpose in an axially fixed manner in the housing 18. In the embodiment shown, a compression spring 45 is provided between the cover 46 and the control drum 22. The compression spring presses the control drum 22 against a base 69 of a receptacle 68 of the housing 18. The control drum 22 is arranged rotatably about the axis of rotation 23 in the receptacle 68. The compression spring 45 compensates for tolerances. An axial movement of the control drum 22 during operation is not provided.

Figure 4:
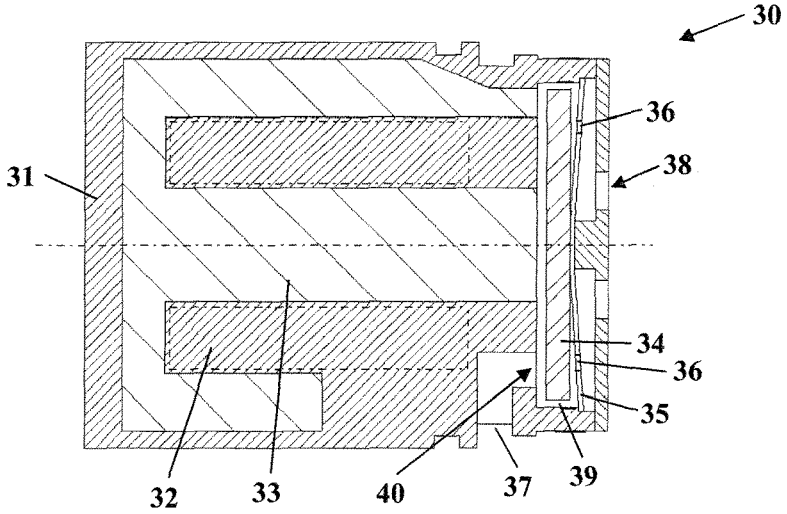
FIG. 4 shows a section through an electromagnetic valve of the carburetor from FIG. 3.

FIG. 4 shows by way of example the configuration of the valve 30. In the embodiment, the valve 30 is a valve which is open in the currentless state. The valve 30 has a housing 31 in which a coil 32, surrounded in a known manner by an iron core 33, is arranged. An armature plate 34 is arranged on the end of the iron core 33. The armature plate is pulled away from the iron core 33 and the coil 32 by a spring element 35. A passage opening 40, which is connected to an entry opening 37 for fuel, opens at the armature plate 34. If the coil 32 is energized, the armature plate 34 is pulled against the passage opening 40 by the coil 32 such that the armature plate 34 closes the passage opening 40. In the open state of the valve 30 shown in FIG. 4, fuel can flow via the entry opening 37, the passage opening 40, a gap 39 formed on the outer circumference of the armature plate 34 between armature plate 34 and housing 31 and through openings 36 in the spring element 35 to one or more exit openings 38 for fuel. The spring element 35 can have any expedient configuration here. The housing 31 is advantageously injection-molded over the coil 32 and the iron core 33. The valve 30 controls the throughput of fuel through the fuel channel 29 over the period of time at which the valve 30 is open. For this purpose, the valve 30 is energized advantageously in a clocked manner.

Figure 5:
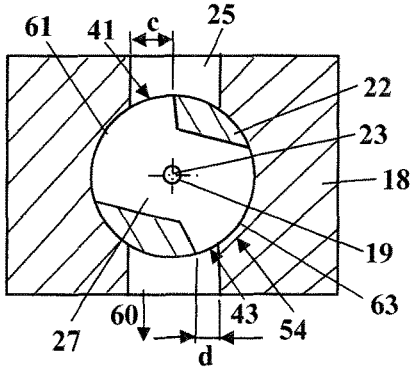
FIG. 5 shows a schematic sectional illustration through the intake channel of the carburetor in the idle position.
Figure 6:
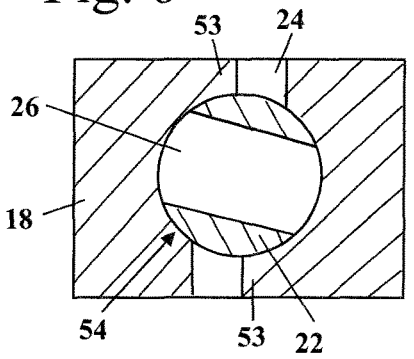
FIG. 6 shows a schematic sectional illustration through the air channel of the carburetor in the idle position.

FIGS. 5 to 10 show the different flow cross sections of intake channel 21 and air channel 8 in the carburetor 11 for different rotational positions of the control drum 22. FIGS. 5 and 6 show the control drum 22 in the idle position 54. In the idle position 54, the control drum 22 is closed as far as possible. The control drum 22 customarily bears against a stop in the idle position 54. An actuation by the operator, for example an actuation of a throttle lever, in order to adjust the idle position 54, is unnecessary.

As FIG. 5 shows, the flow cross section of the section 25 of the intake channel 21 is partially closed by the control drum 22. The entry opening 61 of the control drum 22 only partly overlaps with that section 25 of the intake channel 21 which is formed in the carburetor housing 18. This gives rise to an entry aperture 41 which connects the subsection 27 in the control drum 22 to that section 25 of the intake channel 21 which is formed upstream of the control drum 22. For the sake of better clarity, the entry aperture 41 is not shown in FIG. 3. The entry aperture 41 has a width (c) measured perpendicularly to the direction of flow 60 and perpendicularly to the axis of rotation 23 of the control drum 22. On the downstream side of the control drum 22, the exit opening 63 likewise has an overlap with the downstream section 25 of the intake channel 21. An exit aperture 43 is thereby formed. The exit aperture 43 has a width (d) measured perpendicularly to the direction of flow 60 and perpendicularly to the axis of rotation 23. The width (d) is significantly smaller than the width (c). As a result, the negative pressure prevailing at the fuel opening 19 is lower than the negative pressure in the intake channel 21 downstream of the control drum 22. The quantity of fuel drawn up into the intake channel 21 is thereby reduced in the idle position. The fuel is supplied to the fuel opening 19 under a very slight positive pressure. Fuel is delivered from the fuel opening 19 into the intake channel 21 because of the negative pressure in the intake channel 21. As a result, the negative pressure in the intake channel 21 has a very strong effect on the quantity of fuel drawn up through the fuel opening. By reducing the negative pressure at the fuel opening 19 in the idle position 54, the quantity of fuel supplied can thereby be reduced in a simple manner with an identical opening duration of the valve 30.

FIG. 6 shows the section 24 of the air channel 8 in the idle position 54. In the idle position 54, the control drum 22 closes the air channel 8 such that additional combustion air is not drawn up via the air channel 8. As FIG. 6 also shows, the wall sections 53 of the carburetor housing 18 have the effect that the control drum 22 still keeps the air channel 8 closed in the idle position 54.

Figure 7:
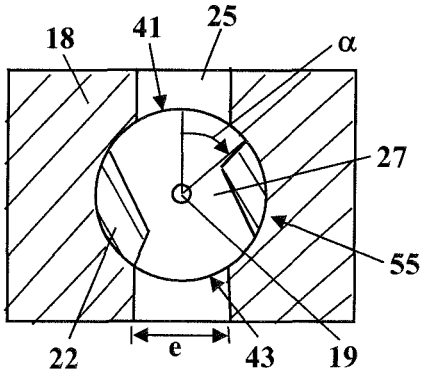
FIG. 7 shows a schematic sectional illustration through the intake channel in the part load position.
Figure 8:
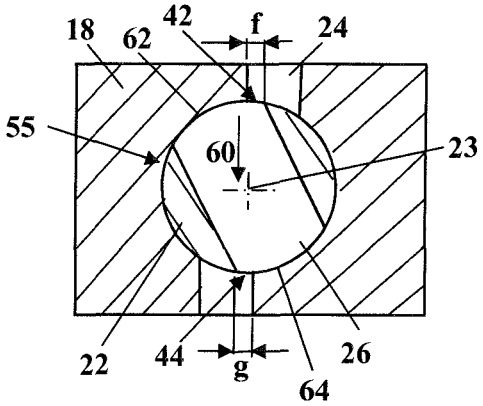
FIG. 8 shows a schematic sectional illustration through the air channel of the carburetor in the part load position.

FIGS. 7 and 8 show the control drum 22 in a part load position 55. In comparison to the idle position 54 shown in FIGS. 5 and 6, the control drum 22 has been rotated about an angle of rotation (a) from the idle position 54 in the direction of the completely open position 56 shown in FIGS. 9 and 10. In the rotational position of the control drum 22 that is shown in FIG. 7, the width (e) of entry aperture 41 and exit aperture 43 is identical in size. This results in identical flow cross sections of entry aperture 41 and exit aperture 43 at a constant height (a) and identical cross-sectional shape. The negative pressure at the fuel opening 19 therefore corresponds to the negative pressure in the intake channel 21 downstream of the control drum 22. Up to the part load position 55 shown in FIG. 7, the flow cross section of the entry aperture 41 is smaller than that of the exit aperture 43. The angle of rotation (α), from which entry aperture 41 and exit aperture 43 have the same flow cross section, is advantageously 20°, in particular 30°, preferably 40°, starting from the idle position 54.

As FIG. 8 shows, the air channel 8 is also open in the part load position 55. The entry opening 62 partially overlaps the section 24 of the air channel 8 in the carburetor housing 18. The exit opening 63 also partially overlaps the section 24 of the air channel 8. The overlap produces an entry aperture 42 into the control drum 22 and an exit aperture 44 out of the control drum 22. The entry aperture 42 has a width (f) measured perpendicularly to the direction of flow 60 and to the axis of rotation 23. The exit aperture 44 has a width (g) measured in the same direction. The widths (f) and (g) are identical in size. The widths (f) and (g) are significantly smaller than the width (e) of entry aperture 41 and exit aperture 44 of the intake channel 21 in the part load position 55 shown. This arises because of the wall sections 53 (FIG. 6).

Figure 9:
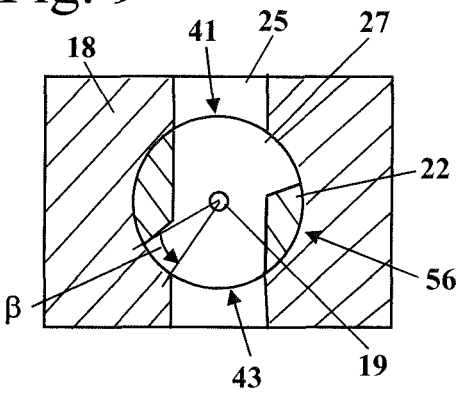
FIG. 9 shows a schematic sectional illustration through the intake channel of the carburetor in the completely open position.
Figure 10:
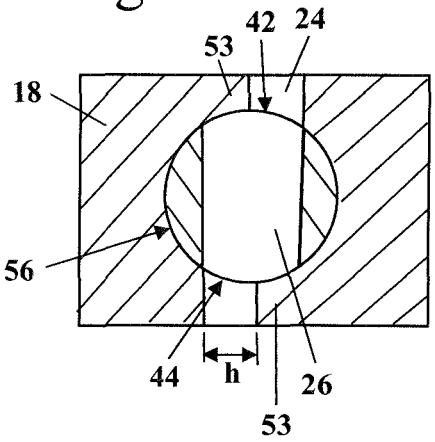
FIG. 10 shows a schematic sectional illustration through the air channel of the carburetor in the completely open position.

FIGS. 9 and 10 show the control drum 22 in the completely open position 56 thereof. The completely open position 56 is assigned to the full load of the two-stroke engine 1. In the completely open position 56, the entry aperture 41 and the exit aperture 43 of the intake channel 21 are completely open. The complete opening of entry aperture 41 and exit aperture 43 is advantageously provided via an angle of rotation (β), which is at least 5°, from the completely open position 56, shown in FIG. 9, in the direction of the idle position 54. The angle (β) is advantageously at least 10°, in particular at least 20°.

In the completely open position 56, the air channel 8 is also completely open, as FIG. 10 shows. The entry aperture 42 and the exit aperture 44 have the same width (h). The width (h) is determined by the wall sections 53.

As FIGS. 5, 7 and 9 schematically show, the free flow cross section of the fuel opening 19 is identical in size for each rotational position of the control drum 22. A needle which controls the flow cross section of the fuel opening 19 depending on the rotational position of the control drum 22 is not provided. In the idle position 54, the flow cross section of the exit aperture 43 of the section 25 of the intake channel 21 is advantageously at most 80% in particular at most 70%, preferably at most 60% of the flow cross section of the entry aperture 41. A flow cross section of the outlet aperture 43 which is approximately 50% of the flow cross section of the entry aperture 41 is considered particularly advantageous.

Figure 11:
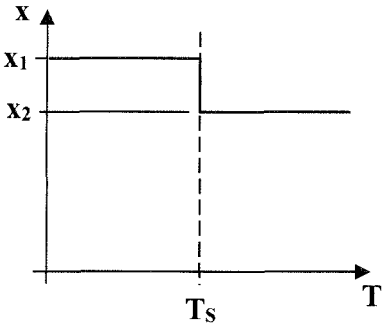
FIG. 11 shows a schematic of the quantity of fuel to be supplied during starting of the internal combustion engine as a function of the temperature; and, FIG. 12 shows a schematic of the quantity of fuel to be supplied as a function of the time.

For starting of the internal combustion engine, advantageously, more fuel is supplied at low temperatures than at higher temperatures. This is shown schematically in FIG. 11. FIG. 11 shows the quantity of fuel (x) to be supplied in dependence on the temperature T. The temperature T is advantageously a temperature of the two-stroke engine 1. The temperature T can be determined, for example, via a temperature sensor 70, shown schematically on the crankcase 4 in FIG. 1. The temperature sensor 70 is connected to a controlling device 71 of the two-stroke engine 1. The temperature sensor 70 may also be provided on the controlling device 71 itself. As FIG. 3 shows, the controlling device 71 is connected to the valve 30 and activates the valve 30. The controlling device 71 also controls the ignition time point at which an ignition spark is triggered by the spark plug 58. Cold starting conditions prevail below a temperature threshold value $T_s$ at the temperature sensor 70 and hot starting conditions prevail above the temperature threshold value $T_s$. As FIG. 11 shows, a first quantity of fuel $x_1$ is supplied below a temperature threshold value $T_s$. Above the temperature threshold value $T_s$, a second quantity of fuel $x_2$ which is less than the quantity of fuel $x_1$ is supplied. The different quantities of fuel ($x_1$, $x_2$) can be achieved, for example, by different opening durations of the valve 30. The valve 30 is activated here advantageously in a clocked manner, for example via a phase-angle control.

Figure 12:
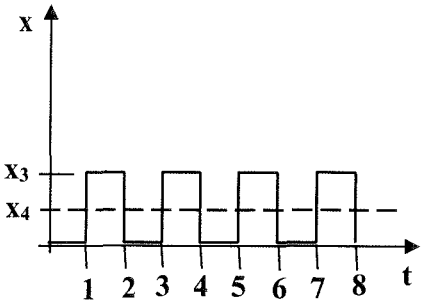

In order to be able to supply the very high quantity of fuel $x_1$, the valve 30 has to be able to ensure a comparatively large maximum volume flow rate. In contrast during the idle, only a small quantity of fuel should be supplied. As FIG. 5 shows, the quantity of fuel drawn up into the intake channel 21 during idle can be adapted by the different flow cross sections of entry aperture 41 and exit aperture 43. In order further to reduce the quantity of fuel (x) supplied during idle, the valve 30 does not open during each engine cycle. This is shown schematically in FIG. 12. The diagram shows the quantity of fuel (x) supplied as a function of the time (t) wherein the time (t) is plotted as number of engine cycles. In the first engine cycle 1, a quantity of fuel $x_3$ is supplied which is significantly less then the quantity of fuel $x_2$ supplied during the hot starting and the quantity of fuel $x_1$ supplied during the cold starting. In the second engine cycle, the valve 30 is kept closed, and therefore fuel is not supplied in the second engine cycle 2. Only in the third engine cycle is a quantity of fuel $x_3$ again supplied. Owing to the fact that fuel is supplied only during every second engine cycle, a reduced quantity of fuel arises in the crankcase 4. This corresponds to a quantity of fuel $x_4$ supplied, shown by a dashed line in FIG. 12. The effectively supplied quantity of fuel can be reduced even further by supplying fuel only every third engine cycle, only every fourth engine cycle, et cetera.

For the operation of the two-stroke engine 1, the temperature T is determined before or during starting. The quantity of fuel (x) to be supplied is defined with reference to the diagram shown in FIG. 11 depending on the temperature T determined. During the starting of the internal combustion engine, the defined quantity of fuel (x) is then metered via the valve 30. A starting position of the control drum 22 is not provided here. During the starting, the control drum 22 is arranged in the rotational position which is shown in FIGS. 5 and 6 and is assigned to idle. An additional throttle element or a choke element for reducing the flow cross section of the intake channel 21 during the starting is not provided. As a result, the operator does not have to engage a choke during the starting and does not have to undertake any operation. The quantity of fuel (x) to be supplied during the starting is automatically adjusted by the controlling means 71 with reference to the temperature T measured.

It is understood that the foregoing description is that of the preferred embodiments of the invention and that various changes and modifications may be made thereto without departing from the spirit and scope of the invention as defined in the appended claims.

What is claimed is:

1. A carburetor comprising:

a housing defining a section of an intake channel having a free flow cross section;

a control drum being rotatably mounted in said housing and configured to control said free flow cross section;

said control drum having a first subsection of said section of said intake channel formed therein;

said section of said intake channel having a second subsection downstream of said first subsection and a third subsection upstream of said first subsection;

said first subsection and said third subsection conjointly defining an entry aperture via which said first subsection is connected to said third subsection when said control drum is in a rotational position;

said first subsection and said second subsection conjointly defining an exit aperture via which said first subsection is connected to said second subsection when said control drum is in said rotational position;

a fuel chamber;

said control drum being rotatable to rotational between an idle position and a completely open position wherein said idle position and said completely open position define respective end positions of said control drum beyond which said control drum cannot be further moved;

said control drum defining a rotational axis and being mounted in said housing so as to prevent a stroke movement in the direction of said rotational axis when said control drum is moved in rotation;

a fuel outlet opening into said first subsection of said section of said intake channel;

an unbranched fuel channel connecting said fuel chamber to said fuel outlet;

an electrically actuated valve for controlling the flow of fuel through said unbranched fuel channel such that the entire quantity of fuel flowing through said unbranched fuel channel to said fuel outlet is controlled by said electrically actuated valve and flows into said intake channel via said fuel outlet, wherein said free flow cross section of said fuel outlet is the same size for each position of said control drum, wherein said fuel outlet is the only fuel outlet in the carburetor opening into said intake channel;

and, said exit aperture has a flow cross section less than the flow cross section of said entry aperture for said idle position so as to cause an underpressure at said fuel outlet to be reduced for said idle position, wherein the flow cross section of said exit aperture is the same size as the flow cross section of said entry aperture for said completely open position of said control drum.

2. The carburetor of claim 1, wherein the flow cross section of said exit aperture is at most 80% of the flow cross section of said entry aperture at said at least one rotational position of said control drum.

3. The carburetor of claim 1, wherein the flow cross section of said exit aperture is less than the flow cross section of said entry aperture for all rotational positions of said control drum, which correspond to a rotation angle (a) of said control drum of 0° to 20° out of said idle position in a direction toward said completely open position.

4. The carburetor of claim 1, wherein the flow cross section of the exit aperture is the same size as the flow cross section of said entry aperture for all rotational positions of said control drum which correspond to a rotation angle (β) of said control drum of 0° to 5° out of said completely open position in a direction toward said idle position.

5. The carburetor of claim 1, wherein said valve is an electromagnetic valve.

* * * * *